US009117357B1

(12) United States Patent
Maghanoy

(10) Patent No.: US 9,117,357 B1
(45) Date of Patent: Aug. 25, 2015

(54) PENDANT TRACKING SYSTEM

(71) Applicant: Jasmine Rose Maghanoy, San Leandro, CA (US)

(72) Inventor: Jasmine Rose Maghanoy, San Leandro, CA (US)

( * ) Notice: Subject to any disclaimer, the term of this patent is extended or adjusted under 35 U.S.C. 154(b) by 107 days.

(21) Appl. No.: 13/927,990

(22) Filed: Jun. 26, 2013

(51) Int. Cl.
*G08B 1/08* (2006.01)
*G08B 21/02* (2006.01)

(52) U.S. Cl.
CPC ..... *G08B 21/0216* (2013.01)

(58) Field of Classification Search
CPC ..... G01S 1/00; G08B 1/00
USPC ..... 340/539.1, 539.11, 573.1, 539.13, 340/539.32
See application file for complete search history.

(56) References Cited

U.S. PATENT DOCUMENTS

| | | | | |
|---|---|---|---|---|
| D279,586 | S | 7/1985 | Flies | |
| D382,912 | S | 8/1997 | Frieden | |
| 5,905,461 | A | 5/1999 | Neher | |
| 6,243,039 | B1 | 6/2001 | Elliot | |
| 6,278,370 | B1 | 8/2001 | Underwood | |
| D494,326 | S | 8/2004 | Long | |
| D538,191 | S | 3/2007 | Wilder | |
| 7,248,170 | B2 | 7/2007 | DeOme et al. | |
| D559,138 | S | 1/2008 | Cothron | |
| 2005/0020274 | A1 | 1/2005 | Ursini | |
| 2008/0062120 | A1* | 3/2008 | Wheeler et al. | 345/156 |
| 2008/0167741 | A1* | 7/2008 | Lay et al. | 700/94 |
| 2009/0289785 | A1* | 11/2009 | Leonard | 340/539.13 |

* cited by examiner

*Primary Examiner* — Daryl Pope

(57) ABSTRACT

A tracking system for enabling a first user to monitor the proximity of a second user features a parent pendant mounted on a parent pendant necklace. The parent pendant features a parent pendant power supply, a parent pendant microprocessor, a parent pendant global positioning satellite component, a parent pendant receiver, a parent pendant continuity wire located in the parent pendant necklace, and a parent pendant alarm. The system features a child pendant mounted on a child pendant necklace. The child pendant features a child pendant power supply, a child pendant microprocessor, a child pendant global positioning satellite component, a child pendant transmitter, and a child pendant continuity wire located in the child pendant necklace. A distance component is monitored between the parent pendant and the child pendant.

11 Claims, 3 Drawing Sheets

PENDANT TRACKING SYSTEM

FIELD OF THE INVENTION

The present invention relates to tracking systems, or more specifically, personal tracking systems worn by a pair of users.

BACKGROUND OF THE INVENTION

Tracking systems and personal monitoring systems have been around in various forms for a number of years. With the development of the global positioning satellite system in recent years, systems have continued to advance with regards to technology. The present invention features a tracking system for enabling a first user to monitor the proximity of a second user while employing the symbolism of identical pendant forms having a mirrored whole image representing parent-child closeness.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a tracking system for enabling a first user to monitor the proximity of a second user. In some embodiments, the system comprises a parent pendant. In some embodiments, the parent pendant is mounted on a parent pendant necklace. In some embodiments, the parent pendant comprises a parent pendant power supply, a parent pendant microprocessor, a parent pendant global positioning satellite (GPS) component, a parent pendant receiver, a parent pendant continuity wire located in the parent pendant necklace, and a parent pendant alarm. In some embodiments, the parent pendant alarm activates via notification from the parent pendant microprocessor.

In some embodiments, the system comprises a child pendant. In some embodiments, the child pendant is mounted on a child pendant necklace. In some embodiments, the child pendant comprises a child pendant power supply, a child pendant microprocessor, a child pendant global positioning satellite (GPS) component, a child pendant transmitter, and a child pendant continuity wire located in the child pendant necklace. In some embodiments, a notification is transmitted to the parent pendant microprocessor via the child pendant transmitter and the parent pendant receiver.

In some embodiments, the child pendant shape is a duplicate of the parent pendant shape. In some embodiments, a child pendant size is a duplicate of a parent pendant size.

In some embodiments, a distance component is monitored between the parent pendant and the child pendant. In some embodiments, upon exceeding the distance component, a notification is generated and transmitted to the parent pendant microprocessor via the child pendant transmitter and the parent pendant receiver. In some embodiments, the parent pendant alarm activates via the notification from the parent pendant microprocessor. In some embodiments, the parent pendant alarm is deactivated only by contacting the parent pendant surface and the child pendant surface.

DESCRIPTION OF PREFERRED EMBODIMENTS

Figure 1:
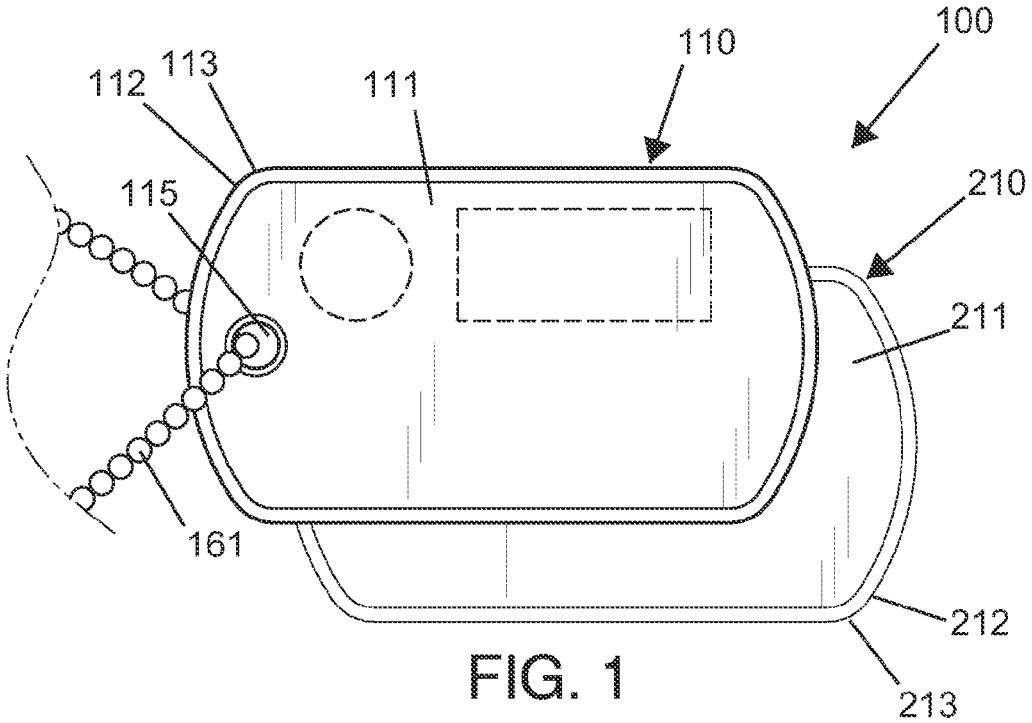
FIG. 1 shows a perspective view of the present invention.
Figure 2:
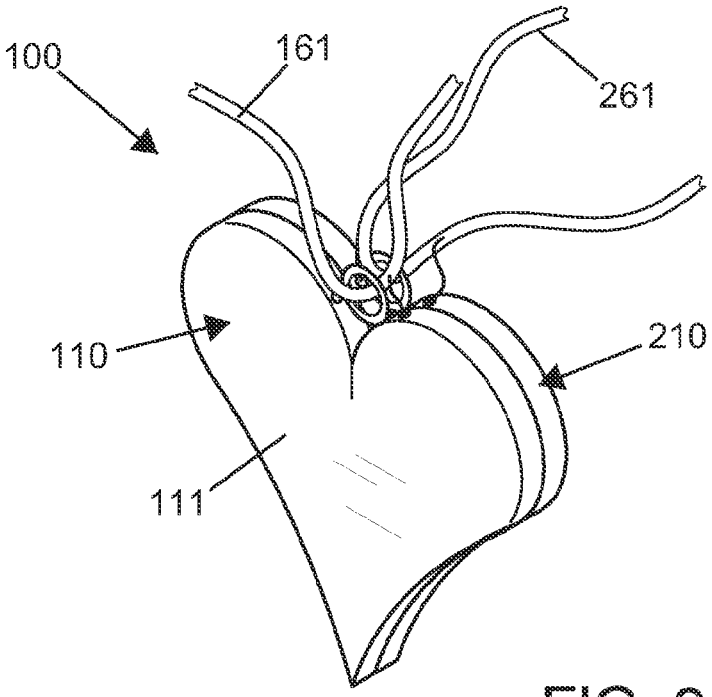
FIG. 2 shows a perspective view of the present invention with a parent pendant surface interfacing with a child pendant surface.
Figure 3:
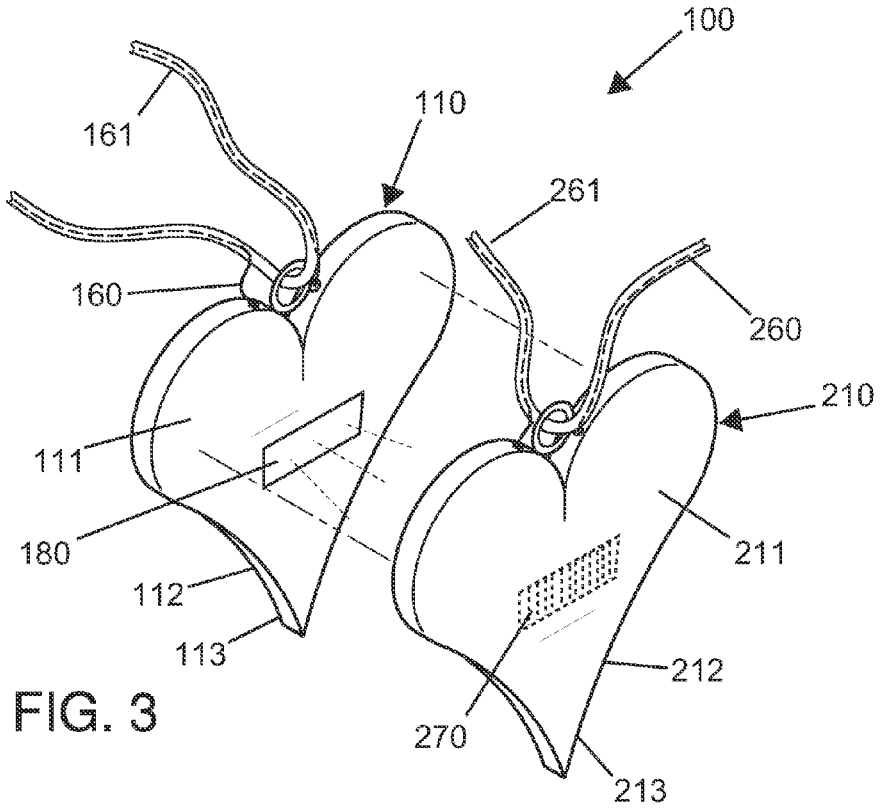
FIG. 3 shows a perspective view of the present invention.
Figure 4:
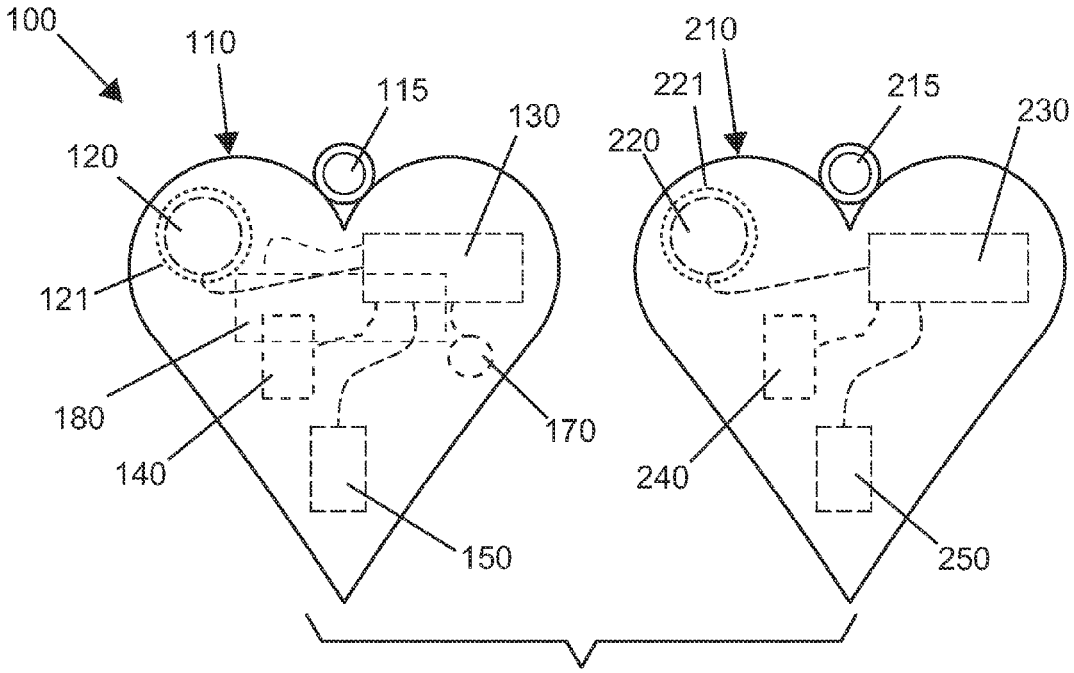
FIG. 4 shows a front view of the present invention.
Figure 5:
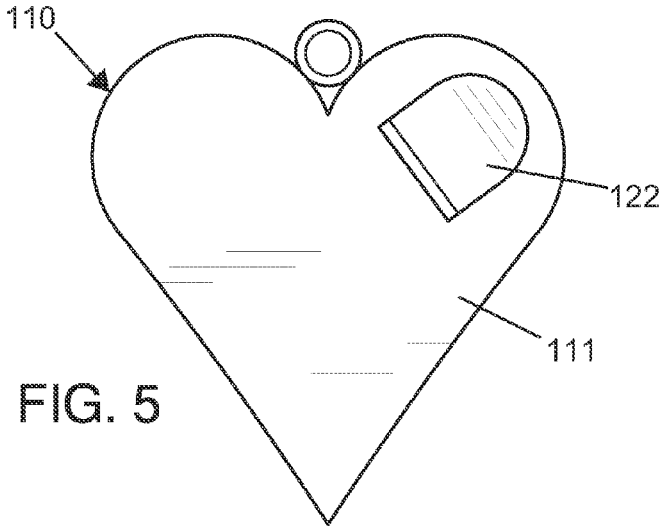
FIG. 5 shows a rear view of a parent pendant of the present invention.
Figure 6:
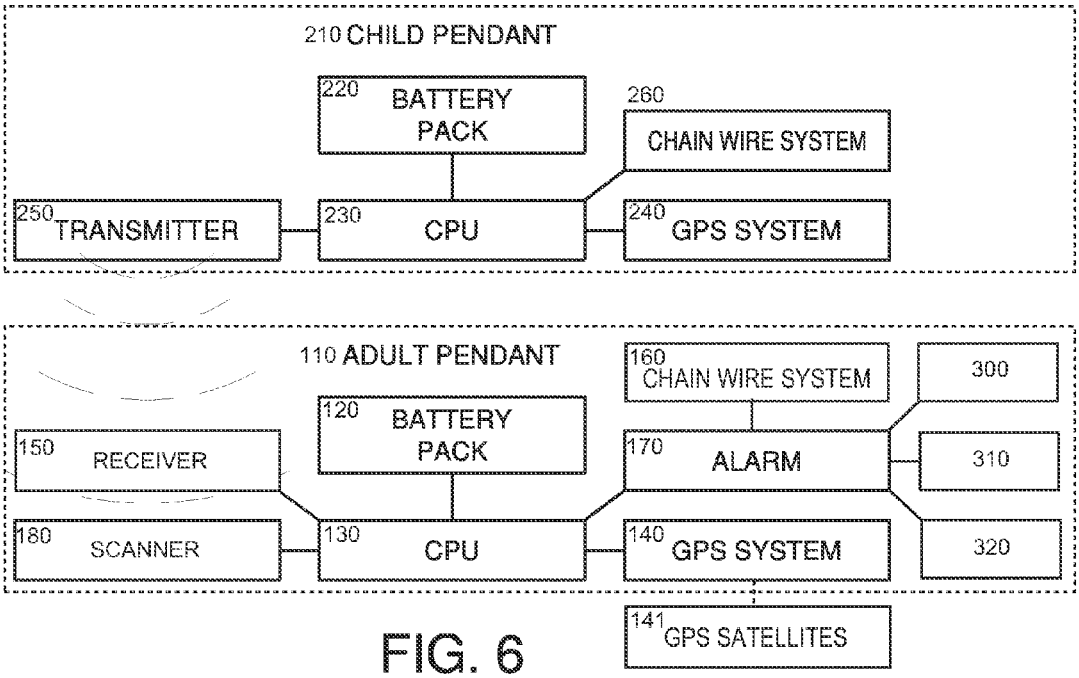
FIG. 6 shows a schematic of the present invention.

Following is a list of elements corresponding to a particular element referred to herein:

100 Tracking system
110 Parent pendant
111 Parent pendant surface
112 Parent pendant shape
113 Parent pendant size
115 Parent pendant aperture
120 Parent pendant power supply
121 Parent pendant cavity
122 Pendant cover
130 Parent pendant microprocessor
140 Parent pendant global positioning satellite component
141 Global positioning satellite system
150 Parent pendant receiver
160 Parent pendant continuity wire
161 Parent pendant necklace
170 Parent pendant alarm
180 Parent pendant scanner
210 Child pendant
211 Child pendant surface
212 Child pendant shape
213 Child pendant size
215 Child pendant aperture
220 Child pendant power supply
221 Child pendant cavity
230 Child pendant microprocessor
240 Child pendant global positioning satellite component
250 Child pendant transmitter
260 Child pendant continuity wire
261 Child pendant necklace
270 Child pendant identification code
300 Speaker
310 Light source
320 Tactile component Referring now to FIG. 1-6, the present invention features a tracking system (100) for enabling a first user to monitor the proximity of a second user. In some embodiments, the system (100) comprises a parent pendant (110) having a parent pendant surface (111). In some embodiments, the parent pendant (110) comprises a parent pendant shape (112). In some embodiments, the parent pendant (110) comprises a parent pendant aperture (115) located therein for mounting on a parent pendant necklace (161).

In some embodiments, the parent pendant (110) comprises a parent pendant power supply (120) located in a parent pendant cavity (121) therein. In some embodiments, the parent pendant cavity (121) is located in the parent pendant (110). In some embodiments, the parent pendant cavity (121) comprises a first removable pendant cover (122).

In some embodiments, the parent pendant (110) comprises a parent pendant microprocessor (130) located therein. In some embodiments, the parent pendant microprocessor (130) is operatively connected to the parent pendant power supply (120).

In some embodiments, the parent pendant (110) comprises a parent pendant global positioning satellite (GPS) component (140) for transmitting and receiving located therein. In some embodiments, the parent pendant GPS component (140) is operatively connected to the parent pendant microprocessor (130). In some embodiments, the parent pendant GPS component (140) sends and receives signals from a global positioning satellite system (141).

In some embodiments, the parent pendant (110) comprises a parent pendant receiver (150) located therein. In some embodiments, the parent pendant receiver (150) is operatively connected to the parent pendant microprocessor (130).

In some embodiments, the parent pendant (110) comprises a parent pendant continuity wire (160) located in the parent pendant necklace (161). In some embodiments, the parent pendant continuity wire (160) is operatively connected to the parent pendant microprocessor (130). In some embodiments, upon disconnection or severance of the parent pendant continuity wire (160), a notification is generated via the parent pendant microprocessor (130).

In some embodiments, the parent pendant (110) comprises a parent pendant alarm (170). In some embodiments, the parent pendant alarm (170) is operatively connected to the parent pendant microprocessor (130). In some embodiments, the parent pendant alarm (170) activates via the notification from the parent pendant microprocessor (130).

In some embodiments, the parent pendant (110) comprises a parent pendant scanner (180). In some embodiments, the parent pendant scanner (180) is operatively connected to the parent pendant microprocessor (130). In some embodiments, the parent pendant scanner (180) is an infrared scanner. In some embodiments, the parent pendant scanner (180) is an optical scanner. In some embodiments, the parent pendant scanner (180) is a magnetic. In some embodiments, the parent pendant scanner (180) is a radio frequency scanner.

In some embodiments, the system (100) comprises a child pendant (210) having a child pendant surface (211). In some embodiments, the child pendant (210) comprises a child pendant shape (212). In some embodiments, the child pendant (210) comprises a child pendant aperture (215) located therein for mounting on a child pendant necklace (261).

In some embodiments, the child pendant (210) comprises a child pendant power supply (220) located in a child pendant cavity (221) therein. In some embodiments, the child pendant cavity (221) is located in the child pendant (210). In some embodiments, the child pendant cavity (221) comprises a second removable pendant cover (122).

In some embodiments, the child pendant (210) comprises a child pendant microprocessor (230) located therein. In some embodiments, the child pendant microprocessor (230) is operatively connected to the child pendant power supply (220).

In some embodiments, the child pendant (210) comprises a child pendant global positioning satellite (GPS) component (240) for transmitting and receiving located therein. In some embodiments, the child pendant GPS component (240) is operatively connected to the child pendant microprocessor (230). In some embodiments, the child pendant GPS component (240) sends and receives signals from the global positioning satellite system (141).

In some embodiments, the child pendant (210) comprises a child pendant transmitter (250) located therein. In some embodiments, the child pendant transmitter (250) is operatively connected to the child pendant microprocessor (230).

In some embodiments, the child pendant (210) comprises a child pendant continuity wire (260) located in the child pendant necklace (261). In some embodiments, the child pendant continuity wire (260) is operatively connected to the child pendant microprocessor (230). In some embodiments, upon disconnection or severance of the child pendant continuity wire (260), a notification is generated via the child pendant microprocessor (230). In some embodiments, the notification is transmitted to the parent pendant microprocessor (130) via the child pendant transmitter (250) and the parent pendant receiver (150).

In some embodiments, the child pendant (210) comprises a unique child pendant identification code (270) located on a child pendant surface (211). In some embodiments, the child pendant identification code (270) is located on the front surface. In some embodiments, the child pendant identification code (270) is located on the back surface. In some embodiments, the unique child pendant identification code (270) is designed to be read by the parent pendant scanner (180). In some embodiments, the unique child pendant identification code (270) is a barcode. In some embodiments, the unique child pendant identification code (270) is a QR™ code or quick response code.

In some embodiments, the child pendant shape (212) is a duplicate of the parent pendant shape (112). In some embodiments, a child pendant size (213) is a duplicate of a parent pendant size (113). In some embodiments, the size and shape of the child pendant with respect to the parent pendant is symbolic and critical to the present invention.

In some embodiments, a distance component is monitored between the parent pendant (110) and the child pendant (210) via the parent pendant GPS component (140), the parent pendant microprocessor (130), the child pendant GPS component (240), and the child pendant microprocessor (230). In some embodiments, the target distance component is predetermined. In some embodiments, the target distance component is programmable. In some embodiments, the distance component is the distance between the parent pendant (110) and the child pendant (210). In some embodiments, the target distance component is ten feet. In some embodiments, the target distance component is twenty feet. In some embodiments, the target distance component is thirty feet. In some embodiments, the target distance component is forty feet. In some embodiments, the target distance component is fifty feet. In some embodiments, the target distance component is one hundred feet. In some embodiments, the target distance component is more than one hundred feet.

In some embodiments, upon exceeding the distance component via increasing the distance between the parent pendant (110) and the child pendant (210), a notification is generated via the child pendant microprocessor (230). In some embodiments, the notification is transmitted to the parent pendant microprocessor (130) via the child pendant transmitter (250) and the parent pendant receiver (150). In some embodiments, the parent pendant alarm (170) activates via the notification from the parent pendant microprocessor (130).

In some embodiments, a distance component is monitored between the parent pendant (110) and the child pendant (210) via the parent pendant GPS component (140), the parent pendant microprocessor (130), the child pendant GPS component (240), and the child pendant microprocessor (230). In some embodiments, upon exceeding the distance component via increasing the distance between the parent pendant (110) and the child pendant (210), a notification is generated via the parent pendant microprocessor (130). In some embodiments, the parent pendant alarm (170) activates via the notification from the parent pendant microprocessor (130).

In some embodiments, the parent pendant alarm (170) is deactivated only by interfacingly contacting the parent pendant surface (111) and the child pendant surface (211). In some embodiments, the parent pendant alarm (170) is deactivated when the parent pendant surface (111) and the child pendant surface (211) approach within a distance of less than 12 inches. In some embodiments, the parent pendant alarm (170) is deactivated when the parent pendant surface (111) and the child pendant surface (211) approach within a distance of less than 6 inches. In some embodiments, the parent pendant alarm (170) is deactivated when the parent pendant surface (111) and the child pendant surface (211) approach within a distance of less than 2 inches. In some embodiments, the parent pendant alarm (170) is deactivated when the parent pendant surface (111) and the child pendant surface (211) approach within a distance of less than 1 inch. In some embodiments, the unique child pendant identification code (270) is then read by the parent pendant scanner (180) for deactivation.

In some embodiments, the parent pendant alarm (170) is deactivated only interfacingly contacting the parent pendant surface (111) and the child pendant surface (211). In some embodiments, a first contact is located on the parent pendant surface (111) and a second contact is located on the child pendant surface (211). In some embodiments, when the first contact touches the second contact, the parent pendant alarm (170) is deactivated. In some embodiments, the method of contact of the child pendant with respect to the parent pendant is symbolic and critical to the present invention. In some embodiments, the parent pendant surface (111) and the child pendant surface (211) are each planar. In some embodiments, the parent pendant surface (111) and the child pendant surface (211) comprise mating surfaces.

In some embodiments, when the parent pendant (110) approaches the child pendant (210) to within a deactivation distance, the parent pendant alarm (170) is deactivated. In some embodiments, the deactivation distance is 1 millimeter. In some embodiments, the deactivation distance is one half inch. In some embodiments, the deactivation distance is one inch. In some embodiments, the deactivation distance is two inches. In some embodiments, the deactivation distance is determined by via the parent pendant GPS component (140), the parent pendant microprocessor (130), the child pendant GPS component (240), and the child pendant microprocessor (230).

In some embodiments, the parent pendant alarm (170) is an audible alarm comprising a speaker (300) located in the parent pendant (110). In some embodiments, the parent pendant alarm (170) is a visual alarm comprising light source (310) located in the parent pendant (110). In some embodiments, the parent pendant alarm (170) is a tactile alarm comprising a tactile component (320) or a vibrating component located in the parent pendant (110).

In some embodiments, the parent pendant shape (112) and the child pendant shape (212) comprise a heart. In some embodiments, the parent pendant shape (112) and the child pendant shape (212) comprise an ellipse. In some embodiments, the parent pendant shape (112) and the child pendant shape (212) comprise a circle. In some embodiments, the parent pendant shape (112) and the child pendant shape (212) comprise a rectangle. In some embodiments, the parent pendant shape (112) and the child pendant shape (212) comprise a polygon. In some embodiments, the parent pendant shape (112) and the child pendant shape (212) comprise rounded corners.

As used herein, term "about" refers to plus or minus 10% of the referenced number.

The disclosures of the following U.S. Patents are incorporated in their entirety by reference herein: U.S. Pat. No. D 559,138; U.S. Pat. No. D 538,191; U.S. Pat. No. D 494,326; U.S. Pat. No. D 382,912; U.S. Pat. No. D 279,586; U.S. Patent Pub. No. 2005/0020274; U.S. Pat. No. 7,248,170; U.S. Pat. No. 6,278,370; U.S. Pat. No. 6,243,039; and U.S. Pat. No. 5,905,461.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures.

The reference numbers recited in the below claims are solely for ease of examination of this patent application, and are exemplary, and are not intended in any way to limit the scope of the claims to the particular features having the corresponding reference numbers in the drawings.

What is claimed is:

1. A tracking system (100) for enabling a first user to monitor the proximity of a second user, wherein the system (100) comprises:

(a) a parent pendant (110) having a parent pendant surface (111), wherein the parent pendant (110) comprises a parent pendant shape (112), wherein the parent pendant (110) comprises a parent pendant aperture (115) located therein for mounting on a parent pendant necklace (161), wherein the parent pendant (110) comprises:

(i) a parent pendant power supply (120) located in a parent pendant cavity (121) therein, wherein the parent pendant cavity (121) is located in the parent pendant (110), wherein the parent pendant cavity (121) comprises a first removable pendant cover (122), (ii) a parent pendant microprocessor (130) located therein, wherein the parent pendant microprocessor (130) is operatively connected to the parent pendant power supply (120), (iii) a parent pendant global positioning satellite (GPS) component (140) for transmitting and receiving located therein, wherein the parent pendant GPS component (140) is operatively connected to the parent pendant microprocessor (130), wherein the parent pendant GPS component (140) sends and receives signals from a global positioning satellite system (141), (iv) a parent pendant receiver (150) located therein, wherein the parent pendant receiver (150) is operatively connected to the parent pendant microprocessor (130), (v) a parent pendant continuity wire (160) located in the parent pendant necklace (161), wherein the parent pendant continuity wire (160) is operatively connected to the parent pendant microprocessor (130), wherein upon disconnection or severance of the parent pendant continuity wire (160), a notification is generated via the parent pendant microprocessor (130), (vi) a parent pendant alarm (170), wherein the parent pendant alarm (170) is operatively connected to the parent pendant microprocessor (130), wherein the parent pendant alarm (170) activates via the notification from the parent pendant microprocessor (130), and (vii) a parent pendant scanner (180), wherein the parent pendant scanner (180) is operatively connected to the parent pendant microprocessor (130); and (b) a child pendant (210) having a child pendant surface (211), wherein the child pendant (210) comprises a child pendant shape (212), wherein the child pendant (210) comprises a child pendant aperture (215) located therein for mounting on a child pendant necklace (261), wherein the child pendant (210) comprises:

(i) a child pendant power supply (220) located in a child pendant cavity (221) therein, wherein the child pendant cavity (221) is located in the child pendant (210), wherein the child pendant cavity (221) comprises a second removable pendant cover (122), (ii) a child pendant microprocessor (230) located therein, wherein the child pendant microprocessor (230) is operatively connected to the child pendant power supply (220), (iii) a child pendant global positioning satellite (GPS) component (240) for transmitting and receiving located therein, wherein the child pendant GPS component (240) is operatively connected to the child pendant microprocessor (230), wherein the child pendant GPS component (240) sends and receives signals from the global positioning satellite system (141), (iv) a child pendant transmitter (250) located therein, wherein the child pendant transmitter (250) is operatively connected to the child pendant microprocessor (230), and (v) a child pendant continuity wire (260) located in the child pendant necklace (261), wherein the child pendant continuity wire (260) is operatively connected to the child pendant microprocessor (230), wherein upon disconnection or severance of the child pendant continuity wire (260), a notification is generated via the child pendant microprocessor (230), wherein the notification is transmitted to the parent pendant microprocessor (130) via the child pendant transmitter (250) and the parent pendant receiver (150), and (vi) a unique child pendant identification code (270) disposed on a child pendant surface (211), wherein the unique child pendant identification code (270) is designed to be read by the parent pendant scanner (180);

wherein the child pendant shape (212) is a duplicate of the parent pendant shape (112), wherein a child pendant size (213) is a duplicate of a parent pendant size (113), wherein a distance component is monitored between the parent pendant (110) and the child pendant (210) via the parent pendant GPS component (140), the parent pendant microprocessor (130), the child pendant GPS component (240), and the child pendant microprocessor (230), wherein upon exceeding the distance component via increasing the distance between the parent pendant (110) and the child pendant (210), a notification is generated via the child pendant microprocessor (230), wherein the notification is transmitted to the parent pendant microprocessor (130) via the child pendant transmitter (250) and the parent pendant receiver (150), wherein the parent pendant alarm (170) activates via the notification from the parent pendant microprocessor (130), wherein the parent pendant alarm (170) is deactivated only by interfacingly contacting the parent pendant surface (111) and the child pendant surface (211), wherein the parent pendant surface (111) touches the child pendant surface (211) such that the unique child pendant identification code (270) is then read by the parent pendant scanner (180) for deactivation.

2. The system (100) of claim 1, wherein the parent pendant alarm (170) is an audible alarm comprising a speaker (300) located in the parent pendant (110).

3. The system (100) of claim 1, wherein the parent pendant alarm (170) is a visual alarm comprising a light source (310) located in the parent pendant (110).

4. The system (100) of claim 1, wherein the parent pendant alarm (170) is a tactile alarm comprising a tactile component (320) located in the parent pendant (110).

5. The system (100) of claim 1, wherein the parent pendant shape (112) and the child pendant shape (212) each comprise a heart.

6. The system (100) of claim 1, wherein the parent pendant shape (112) and the child pendant shape (212) each comprise an ellipse.

7. The system (100) of claim 1, wherein the parent pendant shape (112) and the child pendant shape (212) each comprise a circle.

8. The system (100) of claim 1, wherein the parent pendant shape (112) and the child pendant shape (212) each comprise a rectangle.

9. The system (100) of claim 1, wherein the parent pendant shape (112) and the child pendant shape (212) each comprise a polygon.

10. The system (100) of claim 1, wherein the parent pendant shape (112) and the child pendant shape (212) each comprise rounded corners.

11. A tracking system (100) for enabling a first user to monitor the proximity of a second user, wherein the system (100) consists of:

(a) a parent pendant (110) consisting of:

i. a parent pendant surface (111);

ii. a parent pendant shape (112);

iii. a parent pendant aperture (115) for mounting on a parent pendant necklace (161);

iv. a parent pendant cavity (121) located in the parent pendant (110), wherein the parent pendant cavity (121) consists of a first removable pendant cover (122), v. a parent pendant power supply (120) located in the parent pendant cavity (121) therein, vi. a parent pendant microprocessor (130) located therein, wherein the parent pendant microprocessor (130) is operatively connected to the parent pendant power supply (120), vii. a parent pendant global positioning satellite (GPS) component (140) for transmitting and receiving located therein, wherein the parent pendant GPS component (140) is operatively connected to the parent pendant microprocessor (130), wherein the parent pendant GPS component (140) sends and receives signals from a global positioning satellite system (141), viii. a parent pendant receiver (150) located therein, wherein the parent pendant receiver (150) is operatively connected to the parent pendant microprocessor (130), ix. a parent pendant continuity wire (160) located in the parent pendant necklace (161), wherein the parent pendant continuity wire (160) is operatively connected to the parent pendant microprocessor (130), wherein upon disconnection or severance of the parent pendant continuity wire (160), a notification is generated via the parent pendant microprocessor (130), x. a parent pendant alarm (170), wherein the parent pendant alarm (170) is operatively connected to the parent pendant microprocessor (130), wherein the parent pendant alarm (170) activates via the notification from the parent pendant microprocessor (130), and xi. a parent pendant scanner (180), wherein the parent pendant scanner (180) is operatively connected to the parent pendant microprocessor (130); and (b) a child pendant (210) consisting of:

i. a child pendant surface (211), ii. a child pendant shape (212), iii. a child pendant aperture (215) located therein for mounting on a child pendant necklace (261), iv. a child pendant cavity (221) located in the child pendant (210), wherein the child pendant cavity (221) consists of a second removable pendant cover (122), v. a child pendant power supply (220) located in a child pendant cavity (221) therein, vi. a child pendant microprocessor (230) located therein, wherein the child pendant microprocessor (230) is operatively connected to the child pendant power supply (220), vii. a child pendant global positioning satellite (GPS) component (240) for transmitting and receiving located therein, wherein the child pendant GPS component (240) is operatively connected to the child pendant microprocessor (230), wherein the child pendant GPS component (240) sends and receives signals from the global positioning satellite system (141), viii. a child pendant transmitter (250) located therein, wherein the child pendant transmitter (250) is operatively connected to the child pendant microprocessor (230), and ix. a child pendant continuity wire (260) located in the child pendant necklace (261), wherein the child pendant continuity wire (260) is operatively connected to the child pendant microprocessor (230), wherein upon disconnection or severance of the child pendant continuity wire (260), a notification is generated via the child pendant microprocessor (230), wherein the notification is transmitted to the parent pendant microprocessor (130) via the child pendant transmitter (250) and the parent pendant receiver (150), and x. a unique child pendant identification code (270) disposed on a child pendant surface (211), wherein the unique child pendant identification code (270) is designed to be read by the parent pendant scanner (180);

wherein the child pendant shape (212) is a duplicate of the parent pendant shape (112), wherein a child pendant size (213) is a duplicate of a parent pendant size (113), wherein a distance component is monitored between the parent pendant (110) and the child pendant (210) via the parent pendant GPS component (140), the parent pendant microprocessor (130), the child pendant GPS component (240), and the child pendant microprocessor (230), wherein upon exceeding the distance component via increasing the distance between the parent pendant (110) and the child pendant (210), a notification is generated via the child pendant microprocessor (230), wherein the notification is transmitted to the parent pendant microprocessor (130) via the child pendant transmitter (250) and the parent pendant receiver (150), wherein the parent pendant alarm (170) activates via the notification from the parent pendant microprocessor (130), wherein the parent pendant alarm (170) is deactivated only by interfacingly contacting the parent pendant surface (111) and the child pendant surface (211), wherein the parent pendant surface (111) touches the child pendant surface (211) such that the unique child pendant identification code (270) is then read by the parent pendant scanner (180) for deactivation.

* * * * *